US005753056A

United States Patent [19]

Opalka et al.

[11] Patent Number: 5,753,056

[45] Date of Patent: May 19, 1998

[54] TRANSITION METAL SALT COMPOSITIONS THAT ELIMINATE HYDROGEN ABSORPTION AND ENHANCE HYDROGEN DEGASSING OF ALUMINUM

[75] Inventors: Susanne M. Opalka, Pittsburgh; Joseph T. Laemmle, Delmont, both of Pa.

[73] Assignee: Aluminum Company of America, Pittsburgh, Pa.

[21] Appl. No.: 756,289

[22] Filed: Nov. 25, 1996

[51] Int. Cl.[6] ..... C21D 3/00

[52] U.S. Cl. ..... 148/703; 148/703; 148/417; 420/528

[58] Field of Search ..... 148/703, 417; 420/528

[56] References Cited

U.S. PATENT DOCUMENTS

| | | | |
|---|---|---|---|
| 2,885,313 | 5/1959 | Milliken | 148/6.27 |
| 2,885,315 | 5/1959 | Milliken | 148/13.1 |
| 2,885,316 | 5/1959 | Milliken | 148/13.1 |
| 2,995,479 | 8/1961 | Cochran et al. | 148/13.1 |
| 4,391,655 | 7/1983 | Thurston et al. | 145/20.6 |
| 5,052,421 | 10/1991 | McMillen | 134/2 |
| 5,409,156 | 4/1995 | Tsuji et al. | 228/120 |

*Primary Examiner*—David A. Simmons
*Assistant Examiner*—M. Alexandra Elve
*Attorney, Agent, or Firm*—Elroy Strickland; Tracey D. Beiriger

[57] ABSTRACT

A method of controlling bulk absorption of atomic hydrogen and facilitating degassing of hydrogen from aluminum alloy workpieces during heat treatment in furnaces with ambient and/or moisture-laden atmospheres. The method includes exposing the surface of the workpieces to an acidified inorganic salt solution or dispersion, with the inorganic salt of the solution containing a transition metal cation and a sulfate, phosphate or nitrate anion, before being subjected to the heat treatment. The workpieces are next subjected to the heat treatment, and the acidified transition metal sulfate, phosphate or nitrate salt is used to substantially decrease the amount of atomic hydrogen entering the respective bulks of the workpiece during heat treatment and to facilitate removal of atomic and molecular hydrogen from the bulks of the workpieces.

13 Claims, No Drawings

TRANSITION METAL SALT COMPOSITIONS THAT ELIMINATE HYDROGEN ABSORPTION AND ENHANCE HYDROGEN DEGASSING OF ALUMINUM

BACKGROUND OF THE INVENTION

The present invention relates generally to the problem of aluminum alloy workpieces absorbing hydrogen when undergoing heat treatment in furnaces containing ambient moisture-laden atmospheres, and particularly to a transition metal salt composition that substantially reduces absorption of hydrogen into aluminum alloy workpieces and, in addition, greatly enhances hydrogen degassing of such workpieces.

When an aluminum alloy object is heated in the presence of moist air, a protective oxide layer on the aluminum object is invariably disrupted to expose nascent aluminum. Aluminum oxidation in the presence of water, while in a heated furnace, generates atomic hydrogen, which readily diffuses into the aluminum object, and is the only gas that has appreciable solubility in aluminum. Still, atomic hydrogen has limited solubility in metal and has the propensity to precipitate in the metal as insoluble molecular hydrogen ($H_2$) at heterogeneities or defects, especially in highly worked regions within the metal object. As increasing hydrogen is precipitated within pores in the metal, additional hydrogen can be absorbed and accommodated within the metal matrix. Bulk porosity in an aluminum workpiece can compromise structural integrity and the mechanical performance of the final aluminum part.

For several decades, ammonium fluoborate ($NH_4BF_4$) protective atmospheres have been used in the industry to prevent substantial absorption of hydrogen by aluminum alloy workpieces during high temperature furnace treatments. Ammonium fluoborate decomposes during such treatments at temperatures above 482° F. to form a blanket atmosphere that fills the entire internal volume of a furnace. Ammonium fluoborate also produces an array of compounds in the furnace which can eliminate high temperature oxidation reactions by either reacting with ambient water or by forming a protective fluorinated layer on the aluminum alloy workpiece.

There are drawbacks to the use of ammonium fluoborate atmospheres, however. Ammonium fluoborate species can stain and pit surfaces of some aluminum alloys. The ammonium fluoborate decomposition products contain toxic, corrosive and particulate species. The ammonium fluoborate emissions corrode furnace structures and baghouses for filtering particulate emissions. Disposal of the collected particulates is costly. Concerns relating to the emissions have prompted research to identify alternative chemistries that are more environmentally friendly and safer for in-plant use.

BRIEF SUMMARY OF THE INVENTION

The present invention employs an acidified inorganic transition metal salt treatment composition (solution or dispersion) containing a transition metal cation and a sulfate, phosphate or nitrate anion and 0.01 to 5 wt. % hydrochloric acid. Such a composition eliminates hydrogen absorption and enhances hydrogen degassing of aluminum alloy workpieces in heat treating furnaces containing moist atmosphere. Chlorine and particulate emissions from aluminum parts treated with the composition in furnaces at elevated temperatures is substantially reduced, compared to the fluoride and particulate emissions from furnace practices with ammonium fluoborate atmospheres. The elimination of particulates, of course, eliminates the need and cost of baghouses and landfill sites for the particulates. The subject treatment can be applied to workpieces by dipping, spraying, roller coating or other techniques without subsequent rinsing, prior to heat treatment, with a minimum exposure time of five seconds. During subsequent heat treatments, atomic hydrogen is converted into a chemical species that is insoluble in aluminum. Such a reaction pathway consumes any hydrogen generated by high temperature oxidation reactions at the aluminum surface or outgassed from the bulk of the workpiece. Similar reaction mechanisms with aluminum and/or magnesium metal, metal oxides and/or metal hydroxides have been found to be favorable in this regard. The salt products of aluminum or magnesium ultimately decompose to form oxide/hydroxide phases, releasing the corresponding conjugate acids. In this manner, aluminum oxidation/hydroxylation can occur without additional generation of atomic hydrogen.

In the compositions of the invention, the most effective transition metal cations are iron, copper and nickel, and the effective concentration range of the transition metal salts has been found to be 5 to 10 wt. % salt per total weight of solution or dispersion employed, when water is employed as the solvent carrier. The solution or dispersion is acidified with hydrochloric acid, in a range of 0.01 to 5 percent of the solution, to locally dissolve oxides and facilitate direct oxidation-reduction reactions with the aluminum metal. Transition metal salts have varying solubility characteristics, such that a solvent carrier is chosen to provide adequate solubility or dispersibility of the transition metal salt employed.

Preferred Embodiments

It has been found that a 10 wt. % ferric sulfate aqueous solution acidified with 0.3 wt. % hydrochloric acid is particularly effective in preventing absorption of atomic hydrogen and in degassing hydrogen from the bulk of an aluminum alloy workpiece during furnace treatments in moist atmospheres, though a concentration range of a transition metal sulfate, phosphate or nitrate salt of 2 to 30 percent of the total weight of an aqueous solution or dispersion provides the benefits described herein. The pH of the solution/dispersion can range between 0.1 to 2.5. Appropriate carriers, other than water, may be isopropanol or a low molecular weight, non-aromatic hydrocarbon.

Similarly a 2 to 10 percent ferrous sulfate solution with 0.3 wt. % hydrochloric acid was found to be extremely effective in limiting hydrogen absorption and increasing hydrogen removal. In using the 0.3 wt. % hydrochloric acid composition, aluminum alloy specimens, after heat treatment in a water-saturated atmosphere, consistently had hydrogen levels at less than one-half of unheated ingot. Ten weight percent (10 wt. %) ferric sulfate alone or 10 wt. % ferric sulfate acidified with sulfuric acid were not as effective in reducing hydrogen contents during identical heat treatments. Untreated aluminum samples heated under identical furnace conditions, consistently had hydrogen levels three times that of unheated samples.

The following example and table show that the efficacy of an initial dip treatment in an aqueous ferric sulfate solution acidified with hydrochloric acid, in both providing protection against pickup of atomic hydrogen and facilitating hydrogen extraction in aluminum alloy parts, during heat treatment in a water-saturated atmosphere. At least fifty percent of the initial hydrogen content was extracted (the lower detection limit for hydrogen determination by inert gas fusion analysis technique is 0.05 ppm) during the heat treatment with the ferric sulfate/hydrochloric acid solution deposited on the aluminum surface. When identical parts of the same aluminum alloy stock were heated under the same conditions without the application of the above ferric sulfate solution, the hydrogen accumulated within the bulk of the stock increased three times that of the original content prior to heat treatment. The results show that an initial dip treatment in an aqueous solution with the same level of ferric sulfate, but without hydrochloric acid, afforded only limited protection against pickup of atomic hydrogen during heat treatment of identical aluminum alloy parts under the same heat treatment conditions. Even less protection against pickup of atomic hydrogen was provided during heat treatment of identical aluminum alloy parts under the same conditions, following an initial dip treatment in an aqueous ferric sulfate solution acidified with sulfuric acid.

TABLE I

Change in Aluminum Alloy Hydrogen Level with Dip Treatments and Heat Treatments

| Treatment Chemistry 60 second dip in aqueous solution containing: | Heat Treatment- 10 hour soak at 850 F., in water-saturated atmosphere | Ave. Hydrogen Content (ppm) in Al Alloy bulk- determined by inert gas fusion analyses |
|---|---|---|
| Not conducted (control stock) | Not conducted | 0.10 ± 0.02 (12 samples) |
| 10% $Fe_2(SO_4)_3$, 0.3% HCl | Conducted | 0.05 ± 0.01 (9 samples) |
| Not conducted (control stock) | Conducted | 0.30 ± 0.03 (9 samples) |
| 10% $Fe_2(SO_4)_3$ | Conducted | 0.13 (3 samples) |
| 10% $Fe_2(SO_4)_3$, 2% $H_2SO_4$ | Conducted | 0.22 (3 samples) |

In using the invention, surfaces of a workpiece can be dipped, coated or sprayed with the solution or dispersion of the invention, and then heated in a furnace with an ambient moist atmosphere, without wiping or rinsing the surfaces of the workpiece before placement in the furnace.

In addition to the compositions of the above solutions or dispersions, certain additional agents can be incorporated in the compositions. There may be a need to use dispersants to suspend insoluble transition metal salts in the solvent carrier. There is sometimes the need to use a solvent-based formulation to aid in drying or wetting of workpiece surfaces, using solvents such as alcohol, glycols, glycolether acetates and low molecular weight hydrocarbons. Surfactant species may be incorporated to improve the formulation wetting on aluminum alloy workpiece surfaces and to ensure a more uniform surface reaction.

If the surface of an alumninum alloy workpiece is particularly dirty or oily, the surface can be prepared before dipping by cleaning with a solvent or degreasing agent. In addition, the surface can be prepared by an alkaline etch followed by a deionized water rinse, followed by the application of an acidic desmutting solution followed by a deionized water rinse.

What is claimed is:

1. A method of controlling bulk absorption of atomic hydrogen and facilitating degassing of hydrogen from aluminum alloy workpieces during heat treatments in furnaces with ambient and/or moisture-laden atmospheres, the method comprising:

exposing the surface of an aluminum alloy workpiece to an acidified inorganic salt solution or dispersion, with the inorganic salt of the solution containing a transition metal sulfate, phosphate or nitrate salt having a concentration in the range of 2 to 30% of the total weight of the solution dispersion, before being subjected to said heat treatment;

subjecting said workpiece exposed to the acidified transition metal sulfate, phosphate or nitrate salt to a heat treatment; and using the acidified transition metal sulfate, phosphate or nitrate salt to substantially decrease the amount of atomic hydrogen entering the bulk of the workpiece during heat treatment and to facilitate removal of atomic and molecular hydrogen from the bulk of the aluminum alloy workpiece.

2. The method of claim 1 including using hydrochloric acid as the acid of the solution or dispersion is in the amount lying in the range of 0.01 to 5 percent of the solution or dispersion.

3. The method of claim 1 in which the solution or dispersion is a solvent comprised predominantly of water.

4. The method of claim 1 wherein the pH of solution or dispersion ranges between 0.1 and 2.5.

5. The method of claim 1 wherein the aluminum alloy workpiece is exposed to the solution for a minimum exposure time of five seconds.

6. The method of claim 1 wherein the surface of the aluminum alloy workpiece exposed to the acidified inorganic salt solution or dispersion is subjected to the heat treatment without wiping or rinsing the workpiece surface prior to such heat treatment.

7. The method of claim 1 wherein the aluminum alloy workpiece is subjected to cleaning or degreasing with a solvent or alkaline etch followed by a deionized water rinse and/or an acidic desmutting step, followed by a deionized water rinse, prior to treatment with the acidified inorganic salt solution or dispersion.

8. The method of claim 1 wherein a wetting agent or dispersent is incorporated in the acidified inorganic salt solution or dispersion to facilitate uniform treatment of aluminum alloy workpiece.

9. The method of claim 1 wherein a solvent-based formulation is added to the acidified inorganic salt solution or dispersion to aid drying or wetting the aluminum alloy workpiece surface before the workpiece is subjected to heat treatment.

10. The method of claim 9 wherein the solvent of the added solvent-based formulation is selected from the group consisting essentially of alcohols, glycols, and glyocolether acetates and low molecular weight, nonaromatic hydrocarbons.

11. A method of controlling bulk absorption of atomic hydrogen and facilitating degassing of hydrogen from aluminum alloy workpieces during heat treatments in furnaces with ambient and/or moisture-laden atmospheres, the method comprising:

cleaning or degreasing the surface of an aluminum alloy workpiece with a solvent or alkaline etch followed by a deionized water rinse and/or an acidic desmutting step, followed by a deionized water rinse;

exposing the surface of said aluminum alloy workpiece to an acidified inorganic salt solution or dispersion, with the inorganic salt of the solution containing a transition metal cation and a sulfate, phosphate or nitrate anion, before being subjected to said heat treatment;

subjecting said workpiece exposed to the acidified transition metal sulfate, phosphate or nitrate salt to a heat treatment; and using the acidified transition metal sulfate, phosphate or nitrate salt to substantially decrease the amount of atomic hydrogen entering the bulk of the workpiece during heat treatment and to facilitate removal of atomic and molecular hydrogen from the bulk of the aluminum alloy workpiece.

12. The method of claim 11 in which the inorganic salt is a transition metal sulfate, phosphate or nitrate salt having a concentration in the range of 2 to 30 percent of the total weight of the solution or dispersion.

13. The method in claim 12 in which the inorganic salt is ferric or ferrous sulfate, having a concentration in the range of 2 to 10 percent of the total weight of the solution or dispersion.

* * * * *